United States Patent [19]

Dohm et al.

[11] Patent Number: 4,922,436

[45] Date of Patent: May 1, 1990

[54] METHOD AND SYSTEM FOR THE AUTOMATED DRIVING OF PARTS AND DEVICE USED THEREIN

[75] Inventors: Loring J. Dohm, Troy; Lawrence B. Judge, Sterling Heights; Dwight M. Morgan, Pontiac, all of Mich.

[73] Assignee: GMF Robotics Corporation, Auburn Hills, Mich.

[21] Appl. No.: 199,048

[22] Filed: May 26, 1988

[51] Int. Cl.[5] ..... B25B 23/151

[52] U.S. Cl. ..... 364/513; 81/470

[58] Field of Search ..... 81/467, 469, 470; 173/11, 12, 39, 42, 43; 364/513

[56] References Cited

U.S. PATENT DOCUMENTS

| | | | |
|---|---|---|---|
| 4,386,532 | 6/1983 | Benjamin | 901/46 |
| 4,519,761 | 5/1985 | Kenmochi et al. | 29/799 |
| 4,561,506 | 12/1985 | Booker | 901/41 |
| 4,594,764 | 6/1986 | Yamamoto | 29/824 |
| 4,611,380 | 9/1986 | Abe et al. | 29/458 |
| 4,616,411 | 10/1986 | Suzuki et al. | 29/822 |
| 4,637,776 | 1/1987 | Saito | 901/40 |
| 4,639,996 | 2/1987 | Fullmer | 81/470 |
| 4,805,404 | 2/1989 | Dupin | 81/470 |

*Primary Examiner*—Allen MacDonald

*Attorney, Agent, or Firm*—Brooks & Kushman

[57] ABSTRACT

An end effector device is mounted on the arm of a robot for movement through a predetermined motion relative to control axes of the robot under control of a robot controller which also controls a driver of the device to apply at least one variable programmed drive force to a first part relative to a second part at a work station. Preferably, the driver includes a screwdriver which is driven by an electric motor which, in turn, is controlled to apply a variable programmed torque at a variable programmed speed to a screw. The screwdriver and its electric motor are mounted on a slide for movement between extended and retracted positions relative to a base of the device. An air cylinder is coupled to the slide and is controlled to linearly move the slide so that the screwdriver applies a variable programmed axial force to the screw. The driver has a drive compartment formed therein which is maintained under a negative pressure for receiving and retaining the screw. For clean room applications of the device, the driver has a work compartment formed therein which is maintained under a second negative pressure. The work compartment is in fluid communication with the screw and the second part during driving thereof to evacuate any particulate from the work compartment.

53 Claims, 12 Drawing Sheets

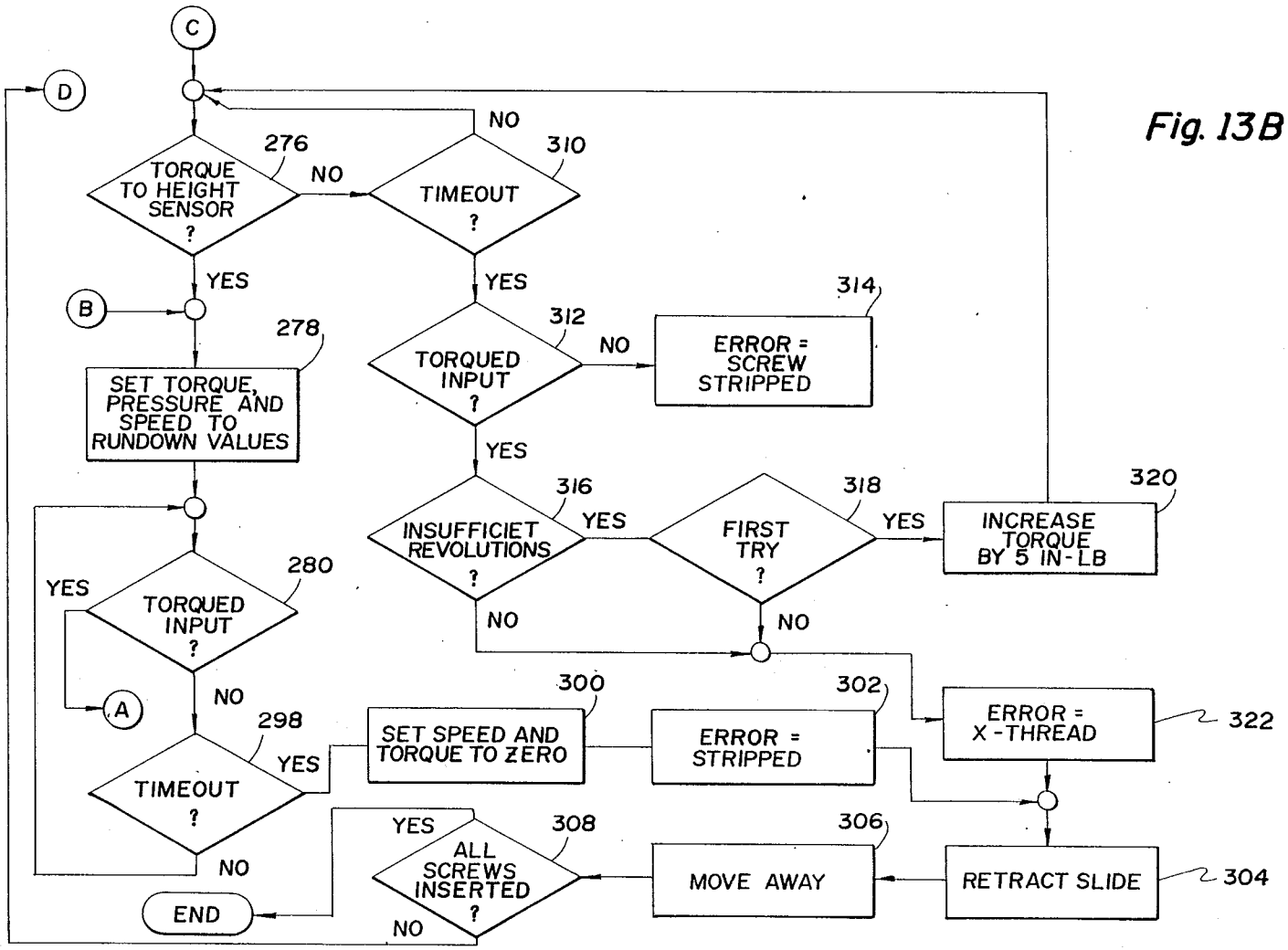
Fig. 13B
C
D
B
A
TORQUE TO HEIGHT SENSOR ?
276
NO
YES
SET TORQUE, PRESSURE AND SPEED TO RUNDOWN VALUES
278
TIMEOUT ?
310
NO
YES
TORQUED INPUT ?
312
NO
YES
ERROR = SCREW STRIPPED
314
INSUFFICIET REVOLUTIONS ?
316
YES
NO
FIRST TRY ?
318
YES
NO
INCREASE TORQUE BY 5 IN-LB
320
TORQUED INPUT ?
280
YES
NO
TIMEOUT ?
298
YES
NO
SET SPEED AND TORQUE TO ZERO
300
ERROR = STRIPPED
302
ERROR = X-THREAD
322
ALL SCREWS INSERTED ?
308
YES
NO
MOVE AWAY
306
RETRACT SLIDE
304
END

METHOD AND SYSTEM FOR THE AUTOMATED DRIVING OF PARTS AND DEVICE USED THEREIN

TECHNICAL FIELD

This invention relates to method and system for the automated driving of a first part relative to a second part and device used therein and, in particular, to method and system for the automated driving of a first part relative to a second part and a device mounted on the arm of a robot which is controlled to move the device relative to at least one control axis.

BACKGROUND ART

The predominant approach today to introduce factory automated technology into manufacturing is to selectively apply automation and create islands of automation. The phrase "islands of automation" has been used to describe the transition from conventional or mechanical manufacturing to the automated factory.

Manufacturing examples of islands of automation include robots for assembly, inspection, painting and welding. To date the major application for industrial robots has been material handling. Included here are such tasks as machine loading and unloading; palletizing/depalletizing; stacking/unstacking; and general transfer of parts and materials - for example between machines or between machines and conveyors.

An example of one such application is disclosed in the U.S. Patent to Kenmochi U.S. Pat. No. 4,519,761.

The '761 Patent discloses a combined molding and assembling apparatus wherein a pallet is conveyed by a conveyor.

The U.S. Patent to Horvah U.S. Pat. No. 4,696,351 discloses a robot having a holder for parts in an assembly area and a head carrying an assembly tool. The head is movable with respect to the part holder by guide supports and is positioned by motors. The head carries in its fixed or sliding mode a device enabling to apply the tool to a part with a predetermined force.

Robots are often an essential ingredient in the implementation of Flexible Manufacturing Systems (FMS) in the automated factory. Early examples of the use of robots for assembling small parts is disclosed in the U.S. Patents to Engelberger et al U.S. Pat. Nos. 4,163,183 and 4,275,986 wherein robots are utilized to assemble parts from pallets onto a centrally located work table. The U.S. patents to Abe et al U.S. Pat. No. 4,611,380 and Suzuki U.S. Pat. No. 4,616,411 disclose fastening apparatus including a bolt receiving and supply device for use in the automated assembly of a door to a vehicle.

The U.S. Patent to Suzuki et al U.S. Pat. No. 4,383,359 discloses a part-feeding and assembling system including multiple stage vibration and magazine feeders. A robot is utilized to change the position of the fed parts for assembly on a chassis supported on a line conveyor.

The major impediment to robotic assembly is economic justification. When the cost of robotic assembly is compared against traditional manual methods or high volume dedicated machinery, robots oftentimes lose out to the high volume, high speed application where hard automation is used. It is difficult for robots to compete in that environment.

On the other side are the low volume, high variety products that are assembled manually. Robots may lack the dexterity to perform these jobs and they may cost more than relatively low paid manual assemblers. There is a middle ground between these two extremes for flexible assembly.

Traditionally, there have been other barriers to the use of robots in mechanical assembly. They include the following: (1) the high cost of engineering a new system which may run three to five times the costs of the robot itself; (2) the amount of time it takes to engineer the system; (3) the difficulty of coordinating multiple robot arms; (4) the difficulty of integrating an assembly system; (5) the high cost of tooling software sensors, part presentation equipment and other peripherals; (6) the difficulty of finding knowledgeable personnel; (7) insufficient speed, lift capacity and positioning accuracy and repeatability on the part of the robots; and (8) a lack of supporting technology in such areas as high level programming languages, end of arm tooling and sensors.

Assembly robots offer an array of benefits that cannot be ignored. They can produce products of high and consistent quality in part because they demand top quality components. Their reprogrammability allows them to adapt easily to design changes and to different product styles. Work in process inventories and scrap can be reduced.

The U.S. Patent to Mayamamoto U.S. Pat. No. 4,594,764 discloses an automated apparatus and method for assembling parts in a structure member such as an instrument panel of an automobile. A conveyor conveys the jig which supports the panel to and from assembly stations. Robots mount the parts on the instrument panel at the assembly stations. Robots are provided with arm-mounted, nut-driving mechanisms supplied from vibratory parts bowls. Vacuum-type grippers and electromagnetic grippers are advantageous because they permit part acquisition from above rather than from the side. This avoids the clearance and spacing consideration that are often involved when using mechanical grippers.

However, the use of vacuum and electromagnetic grippers is not without its problems. Cycle time is not just a function of robot speed and acceleration/-decelerating characteristics. Cycle time is also dependent on how fast the robot can move without losing control of the load. Horizontal shear forces must be considered in the application of these grippers. This often means that the robot is run at something less than its top speed.

A wide variety of tools have been used by robotic manipulators. Such tools include screw fastening units. United States Patents to Booker U.S. Pat. No. 4,561,506 and Saito U.S. Pat. No. 4,637,776 are examples of such screw-fastening units mounted on a robotic manipulator for movement therewith.

The U.S. Patent to Yasukawa U.S. Pat. No. 4,518,298 discloses a head for an industrial robot which operates at a relatively high speed and with a relatively small drive force. A motor generates rotational torque to a nut member through a rotational coupling mechanism.

DISCLOSURE OF THE INVENTION

An object of the present invention is to provide an improved method, system and device for use therein for the reliable and flexible assembly of assemblies such as assemblies wherein a first part is driven into a second part.

Another object of the present invention is to provide an improved method, system and device for use therein for the reliable and flexible assembly, reassembly and/or disassembly of assemblies such as assemblies wherein a first part which is driven relative to a second part.

Yet still another object of the present invention is to provide an improved method, system and device for use therein for the flexible and cost-effective assembly, reassembly and disassembly of assemblies wherein a variable, programmable, force profile is provided for a "human-like" touch when assembling and reassembling.

In carrying out the above objects and other objects of the present invention, a method for the automated driving of a first part relative to a second part at a work station is provided. The method utilizes a robot system which includes a robot having an arm provided with a device movable relative to at least one control axis. The device includes a driver for driving the first part relative to the second part which is positioned at a part location in the work station. The method includes the steps of automatically moving the device through a predetermined motion relative to the at least one control axis to a position adjacent the part location. Then, the device is automatically controlled so that the driver drives the first part relative to the second part. The method is characterized by controlling the driver so that the driver applies at least one variable programmed force to the first part.

Further in carrying out the above objects and other objects of the present invention, a system for controlling the automated driving of a first part relative to a second part at a work station is provided. The system includes a robot having an arm, a controller for controlling the robot in accordance with a robot control signal and a device mounted on the robot arm and movable relative to the at least one control axis. The device has a driver for driving the first part relative to the second part which is positioned at a part location in the work station. The system is characterized by the controller controlling the device so that the driver applies at least one variable programmed force to the first part in accordance with a drive control signal.

Yet still further in carrying out the above objects and other objects of the present invention, a device for use in an automated part driving system is provided. The part driving system includes a robot having an arm adapted to support the device for movement relative to at least one control axis of the robot. The part driving system further includes a controller for providing control signals, including a robot control signal. The robot moves the device at a work station relative to the control axis to permit the device to automatically drive a first part relative to a second part located at the work station. The device includes a base adapted to be connected to the robot arm for movement therewith and a driver including a drive tool and actuator means adapted to receive a first drive control signal from the controller and coupled to the drive tool so that the drive tool applies at least one variable programmed force to the first part in accordance with the first drive control signal.

Preferably, the first part is a screw and the driver includes a screwdriver for applying a variable programmed torque to the screw.

Also, preferably, the screwdriver is controlled to apply a variable programmed axial force to the screw as the screwdriver drives the screw at a variable programmed speed.

The advantages accruing to the method, system and device of the present invention are numerous. For example, because multiple, programmable torque levels are provided, only one drive tool need be provided for many applications. Also, the device is readily adaptable for clean room applications. When the driver takes the form of a screwdriver and the first part takes the form of a screw-type fastener, the device is capable of providing alignment of the screwdriver bit to the fastener head in a unique fashion prior to the beginning of a screw installation process.

The advantages of the present invention will be readily appreciated as the same becomes better understood by reference to the following detailed description when taken in connection with the accompanying drawings.

BRIEF DESCRIPTION OF THE DRAWINGS

FIGS. 13A and 13B illustrate in a flow chart, block diagram the various steps of the method and operation of the present invention.

BEST MODE FOR CARRYING OUT THE INVENTION

Figure 1:
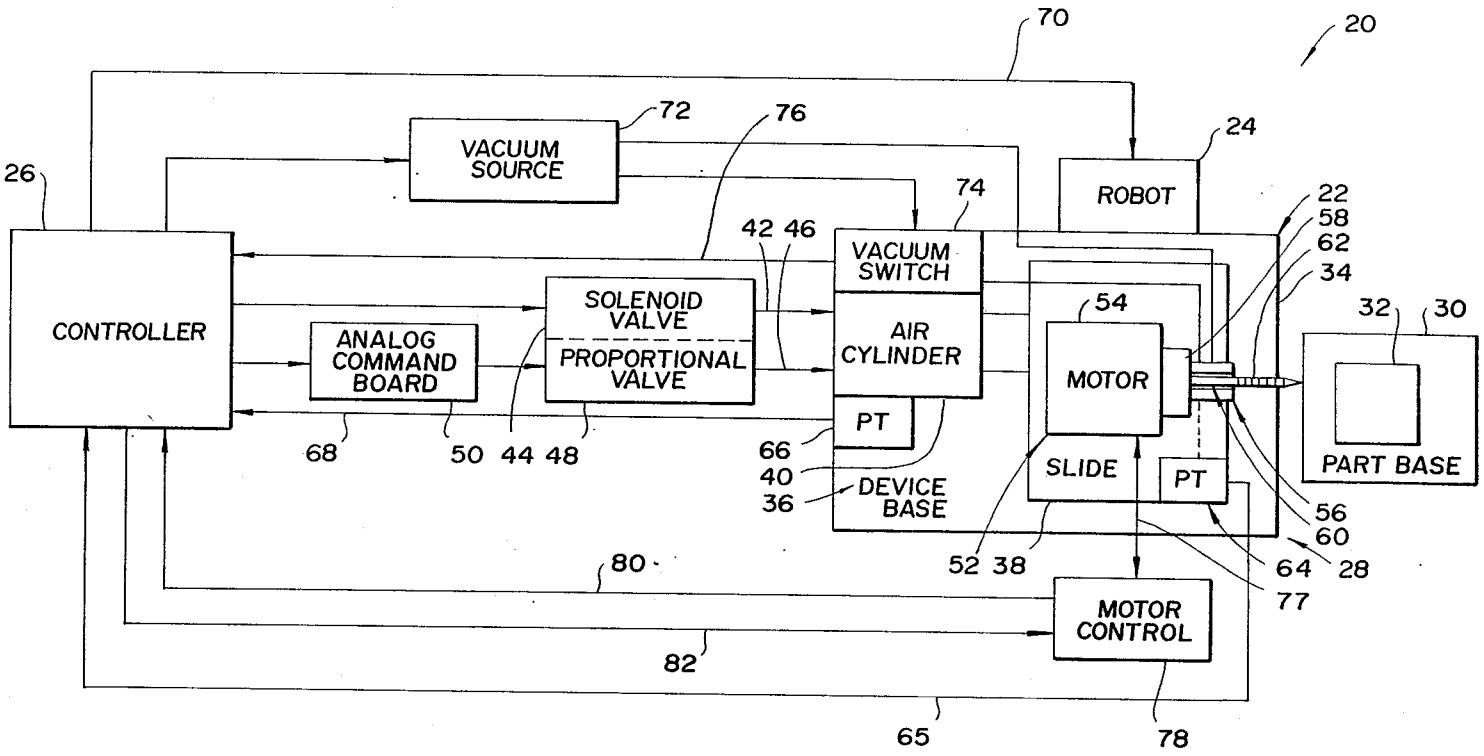
FIG. 1 is a schematic block diagram view illustrating the operation of the method and system of the present invention with respect to a part located at a work station or cell.

Referring now to FIG. 1, there is illustrated in schematic form the method and system for automated driving of a first part with respect to a second part at a work station in accordance with the present invention. In particular, the method and system of the present invention are capable of driving parts and fasteners of various shapes and sizes through a wide range of variable torques. Furthermore, the method and system provide a programmable advancing thrust profile for "human-like" touch when installing and retorquing parts and fasteners, such as screw fasteners. Also, the method and system are readily adaptable for use in clean room applications. Use of the method and system not only result in high productivity, but also in high quality.

A system constructed in accordance with the present invention is generally indicated at 20. The system 20 includes a device, generally indicated at 22, which is intended, but not limited to being employed as an end effector mounted at the distal end of a robot, such as a robot 24 of a robot system which also includes a robot controller 26. The robot 24 is located at a work station, or cell 28. At the work station 28, the controller 26 is typically capable of communicating with programmable controllers, numerically controlled machinery, vision systems, plant data management systems and the like.

The device 22 may be readily changeable so that a different device may be used as an end effector on the same robot as is described in greater detail hereinbelow.

As illustrated in FIG. 1, the robot 24 is utilized to move the device 22 through a variable programmed motion relative to a part base 30 and a part 32 supported thereby. However, it is to be understood that the device 22 may be utilized in other systems for driving a first part relative to a second part.

The positions of the second part 32 relative the part base 30 and the part base 30 may be known by the controller 26. However, a 2-D or 3-D machine vision system could be used to allow the robot 24 to adjust its variable programmed path if the positions are not known. A camera for such a system could be mounted on the robot 24 or, alternatively, could be mounted in an overhead location within the work station 28.

The device 22 is the end effector of the robot 24 and includes a device base 34 on which a driver, generally indicated at 36 is mounted. The driver 36 includes a slide 38 which is movable linearly with respect to the base 34 as will be described in greater detail hereinbelow.

The driver 36 further includes an actuator means or mechanism which, in turn, includes an air cylinder 40. The air cylinder 40 is coupled to the slide 38 and the base 34 to linearly move the slide 38 relative to the base 34. The air cylinder 40 alternately extends or retracts in response to a drive control signal on line 42 from a solenoid valve 44 which, in turn, is controlled from the controller 26.

The air cylinder 40 receives a separate drive control signal along line 46 from a proportional valve 48 which regulates the air pressure of the air cylinder 40 to, in turn, provide a variable axial force to the slide 38. The proportional valve 48 is controlled from an analog control or command board 50 to provide a variable cylinder pressure signal to the proportional valve 48 in response to a control signal from the controller 26.

A motor assembly, generally indicated at 52, is mounted on the slide 38 to move therewith. The motor assembly 52 includes an electric motor 54 of the actuator mechanism. The motor assembly 52 includes a tip assembly, generally indicated at 56, which is coupled to the motor 54 by a coupler 58. The tip assembly 56 includes a drive tool or drive bit, generally indicated at 60, which is coupled in driving engagement through the coupler 58 to the motor 54. The drive bit 60 drivingly engages a first part or screw fastener 62 to drive the screw fastener 62 into the second part 32, as will be described in greater detail hereinbelow.

A position transducer, generally indicated at 64, is mounted on the slide 38 for movement therewith and is associated with the tip assembly 56 to provide a position feedback signal along line 65 to indicate the relative position of the screw fastener 62 with respect to the second part 32, which will also be described in greater detail hereinbelow.

Another position transducer 66 is mounted on the base 34 for movement therewith and is associated with the air cylinder 40 to provide a position feedback signal along line 68 to the controller 26. The position feedback signal on the line 68 indicates that the air cylinder 40 is fully retracted so that the controller 26 can provide a robot control signal along a line 70 so that the robot 24 can safely move the device 22 away from the second part 32.

The drive bit 60 engages a head portion of the screw fastener 62 within a drive compartment formed in the tip assembly 56. A vacuum source 72 under the control of the controller 26 maintains a negative pressure within the drive compartment through a vacuum switch 74 also mounted on the device base 34. The negative pressure within the drive compartment holds the screw fastener 62 within the tip assembly 56. The vacuum switch 74 provides a signal to the controller 26 along a line 76 when the screw fastener 62 is properly received within the drive compartment of the tip assembly 56.

The vacuum source 72 also applies a second negative pressure within a work compartment formed in the tip assembly 56 under control of the controller 26 in clean room applications of the device 22. The second negative pressure within the work compartment of the bit assembly 56 prevents particles from contaminating the environment in such clean room applications. Otherwise, the second negative pressure can be used as an assist to hold the screw fastener or to cool the motor 54 during heavy duty cycles.

The motor 54 is controlled from the controller 26 by a motor control 78. The motor control 78 includes drive enable, drive forward and drive reverse circuits. The motor control 78 receives torque and speed commands from the controller 26 along a line 82 to thereby control the torque and speed of the motor 54 as it drives the drive bit 60.

As can be readily appreciated, the analog values for torque, speed and cylinder pressure can be changed as required in the controller 26 to meet the demands of the application. Typically the torque range of the driver 36 is one pound per inch through 25 pounds per inch. Also, preferably, the rpm of the drive bit 60 is in the range of 30 rpm to 400 rpm. The slide stroke of the slide 38 is approximately 1½ inches.

The motor control 78 senses the back EMF of the motor 54 on a cable 77 and sends a feedback signal along line 80 to the controller 26 which converts the signal into the actual rpm of the driver bit 60. The cable 77 includes wires which extend between the motor control 78 and the motor 54 through an aperture 79 extending through the slide 38. As the back EMF goes up near the end of a drive cycle, the controller 26 senses a stall condition.

Also, the motor control 78 feeds back along line 80 a signal which represents a portion of the torque current supplied to the motor 54 or cable 77 by the motor control 78 so that the controller 26 can properly output the correct torque signal along line 82 to the motor control 78.

By monitoring the rpm of the driver bit 60, the controller 26 effectively monitors the position of the screw fastener 62 if the number of threads on the screw fastener 62 are known.

Referring now to FIGS. 2 through 12 there is illustrated in detail the device 22 constructed in accordance with the present invention. As previously mentioned, the device 22 includes a base or first housing member 34. The slide 38 preferably comprises a support plate which is slidably mounted on one side of the base 34 by a liner bearing, generally indicated at 90 in FIG. 12. A mount or adaptor 91 is secured to the opposite side of the base 34 for connecting the device 22 to a wrist of the robot 24 or other peripheral device.

Figure 6:
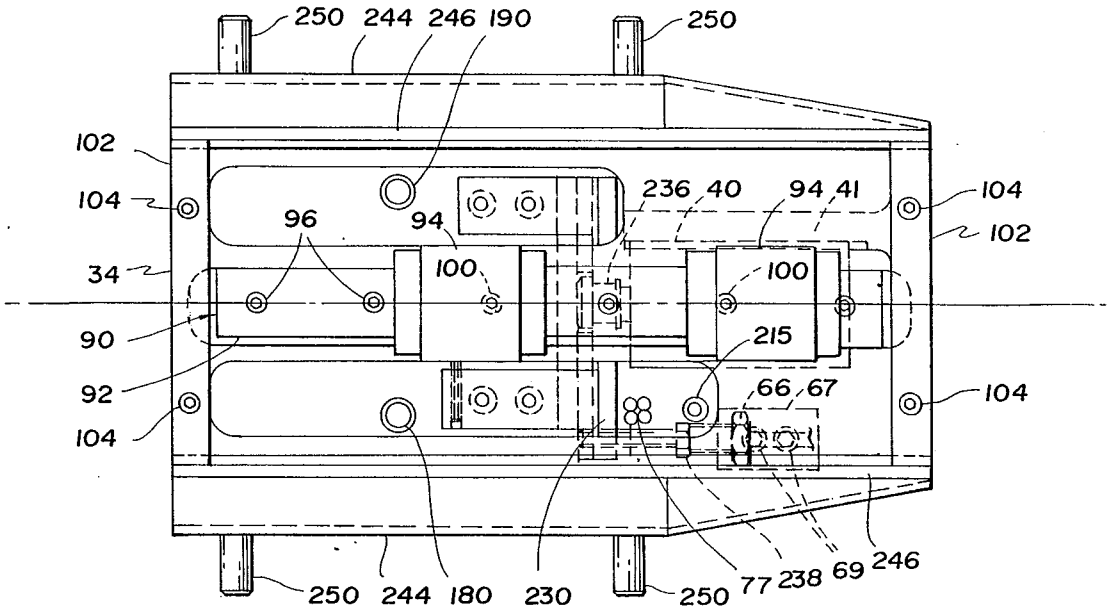
FIG. 6 is a sectional view taken along lines 6—6 of FIG. 2.

With particular reference to FIG. 6, the linear bearing 90 includes a base member 92 which is attached at the top surface of the base 34 by screws 96. Slidable members 94 of the linear bearing 90 are threadedly attached to the slide 38 by screws, such as a screw 100. Stops 102 are threadedly secured to the top surface of the base 34 at opposite ends thereof by fasteners 104 to limit sliding movement of the members 94.

The motor 54 of the assembly 52 is supported by and within a housing member 106 and a motor bracket 108. A set screw 114 extends through the housing 106 and fixes the position of the motor 54 within the housing 106. The motor bracket 108 is fixedly secured to the slide 38 by screw and washer assemblies 110. The housing member 106 is likewise secured to the slide 38 by screws, such as a screw 112.

The motor 54 is further supported on the slide 38 by a second housing member 116. The second housing member 116 is fixedly secured to the slide 38 by dowels 117 and screws, such as screws 118. The two housing members 106 and 116 are connected together by pins 120 and bolts 122.

Figure 5:
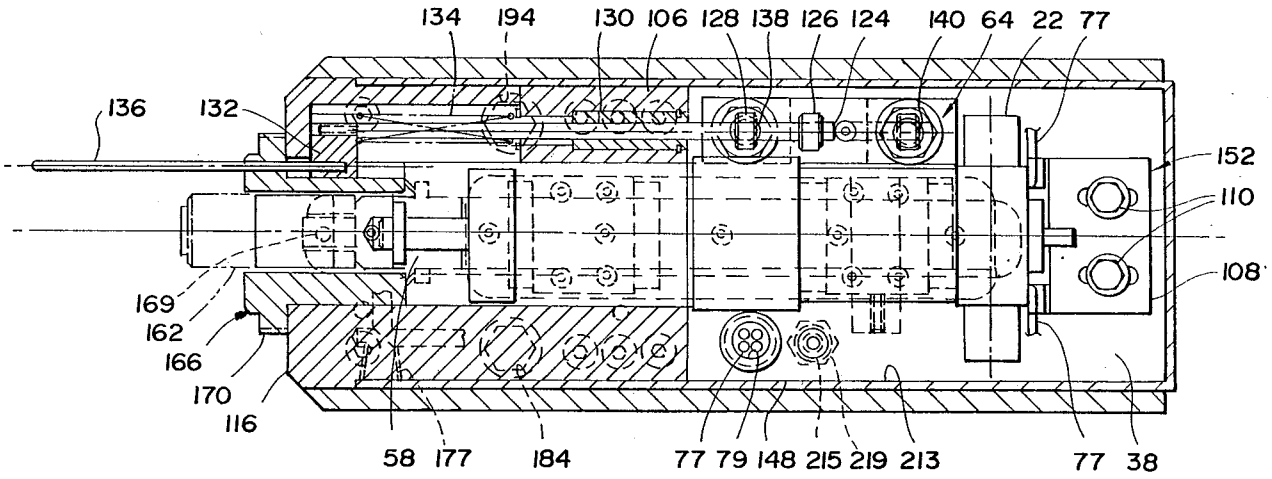
FIG. 5 is a sectional view taken along lines 5—5 of FIG. 2.

The position transducer 64 is best illustrated with reference to FIGS. 5 and 9. The position transducer 64 includes a shaft 124 on which there is mounted a pair of spaced collars 126 and 128, respectively. The shaft 124 is mounted within a bushing 130 which, in turn, is mounted within the housing 106 by locking rings to permit sliding movement of the shaft 124 relative to the housing 106. One end of the shaft 124 is secured within a block 132. A spring 134 extends between the block 132 and the housing 106 to bias the shaft towards the left as shown in FIG. 5.

Also secured within the block 132 is a screw or drill rod 136. A set screw 98 secures the screw rod 136 within the block 132.

A pair of proximity switches 138 and 140 further define the position transducer 64 by providing position feedback signals along line 65 back to the controller 26. The proximity switches 138 and 140 supply signals when either one of the collar members 128 and 126 are positioned adjacent thereto. The proximity switches !38 and 140 are mounted on the slide 38 by a switch plate 142, a spacer 144 and screws 146 which slidably mount the resulting assembly to the slide 38.

Figure 11:
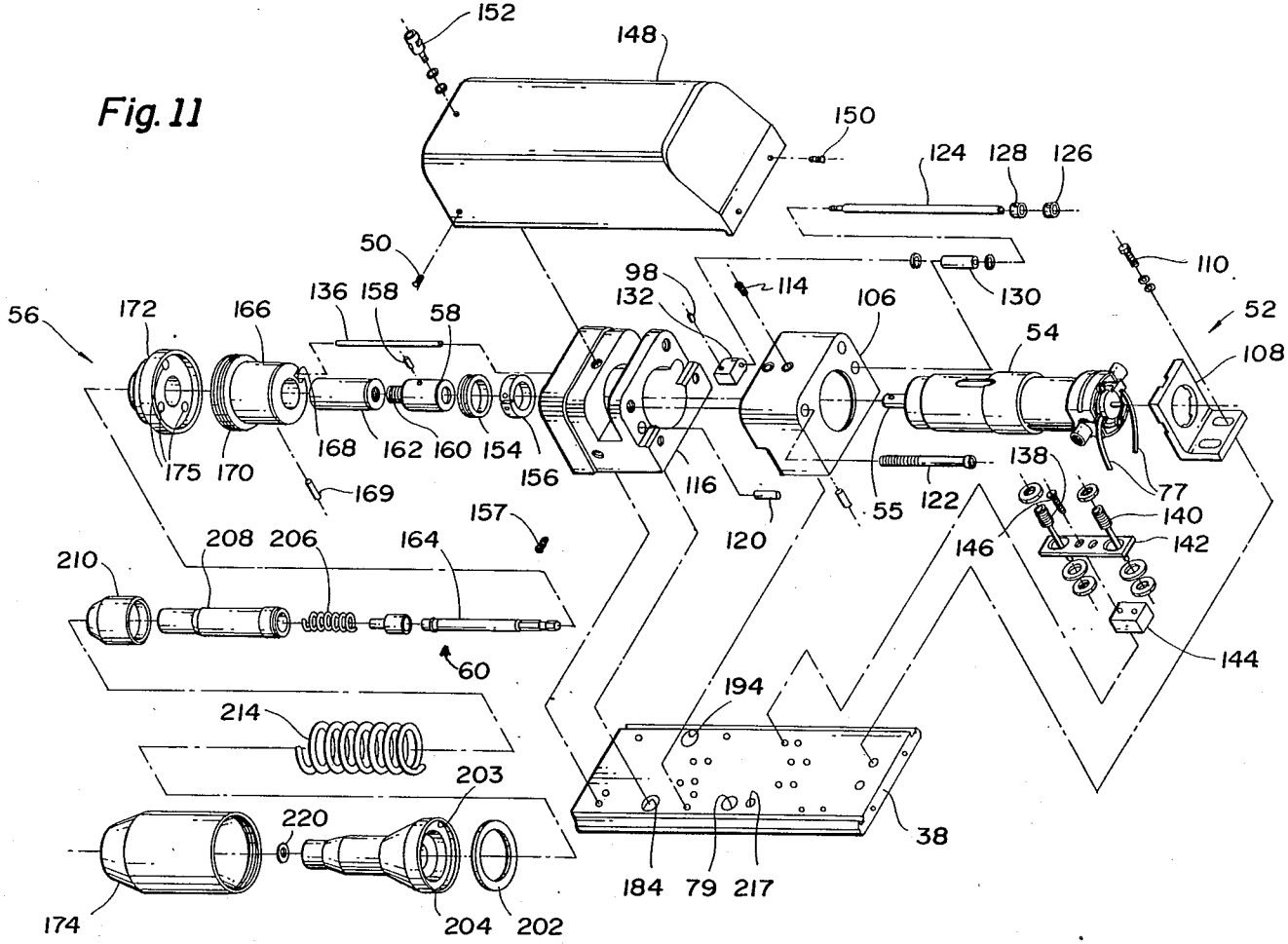
FIG. 11 is an exploded perspective view of a top half of the device.

With particular reference to FIG. 11, the motor assembly 52 is housed on the slide 38 by a cover 148 which is secured to the slide 38 by screws 150. The cover 148 is properly positioned relative to the housing 116 by a locating pin and washer assembly 152 which extends through the top of the cover 148 and into the housing member 116.

Figure 8:
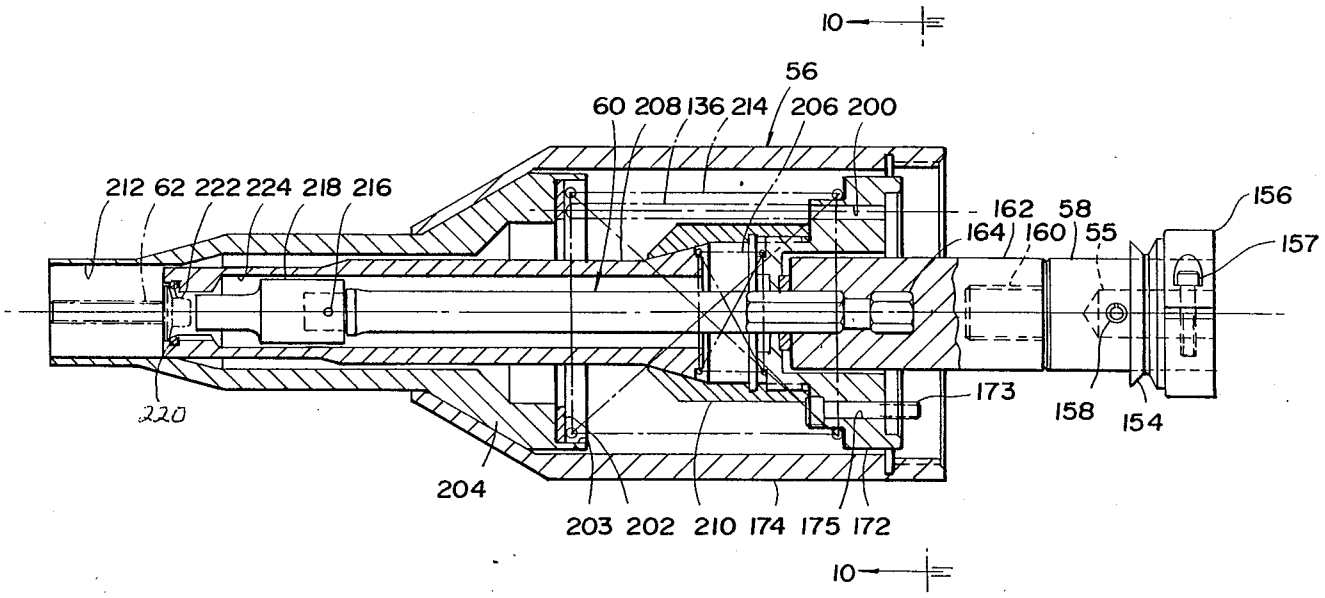
FIG. 8 is a sectional view of a screwdriver tip assembly indicated in phantom in FIG. 2.
Figure 9:
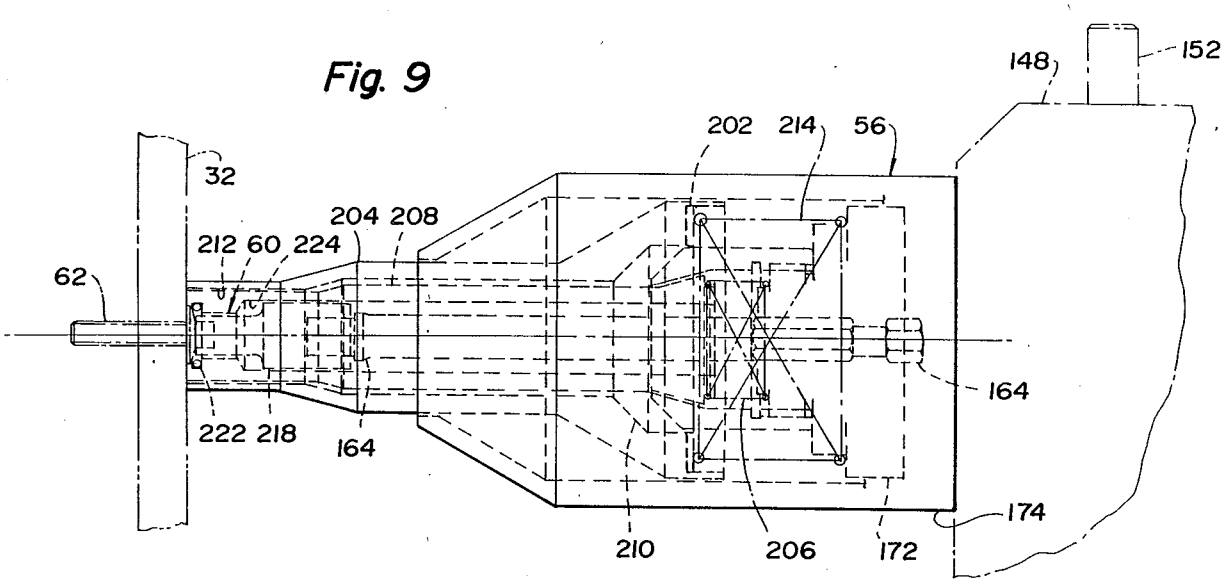
FIG. 9 is a side elevational view of the tip assembly in a work position in a clean room application with a screw fastener in driving engagement therewith.
Figure 10:
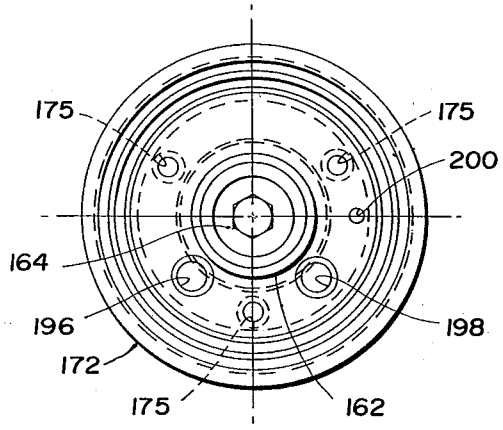
FIG. 10 is a sectional view taken along lines 10—10 of FIG. 8.

Referring now to FIGS. 8–10 in combination with FIG. 11 there is illustrated in detail the tip assembly 56 which is coupled to the output shaft 55 of the motor 54 by means of the adaptor 58. The tip assembly 56 is sealed from the rest of the motor assembly 52 by a vacuum sealing ring 154 which is held against a nose, generally indicated at 166, by a clamp 156 and a set screw 157. A roll pin 158 secures the adaptor 58 to the output shaft 55.

Figure 2:
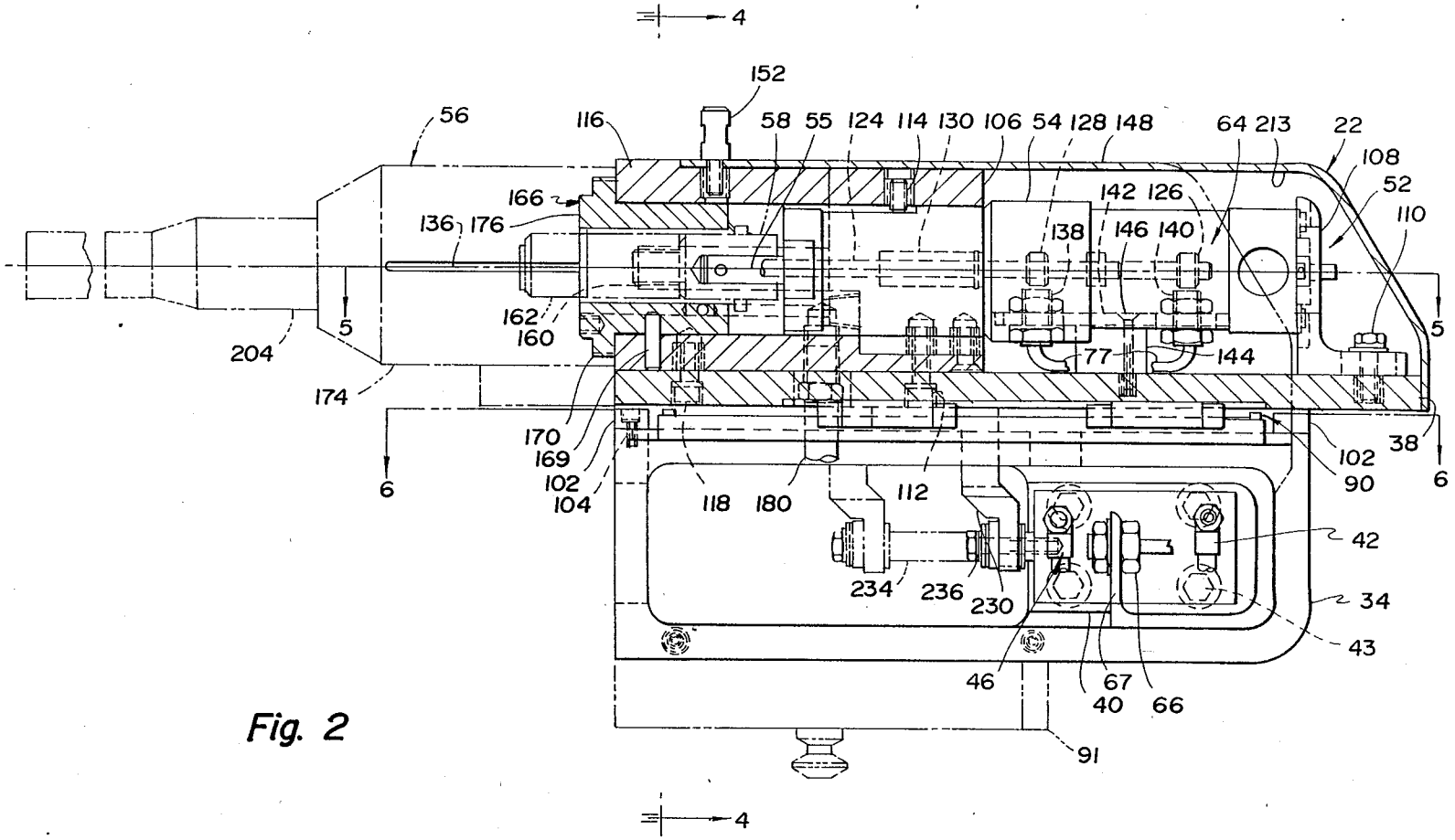
FIG. 2 is a sectional view of the device constructed in accordance with the present invention taken along lines 2—2 in FIG. 4.

The adaptor 58 includes a threaded portion 160 which is threadedly secured to a quick release socket or chuck 162 of the drive bit 60. The chuck 162 is in driving engagement with an extension drive 164 of the drive bit 60. The chuck 162 passes through the nose or adaptor 166 which, in turn, is supported in the housing 116, as shown in FIGS. 2 and 5 by a set screw 169. The drill rod 136 extends through the nose 166 at a groove 168 formed therein.

An adaptor 172 is threadedly secured to a threaded portion 170 of the nose 166 by screws 173. The relative angular position of the adaptor 172 is maintained relative to the nose 166 by the screws 173. The adaptor 172 is centered on a pilot diameter 176 on the face of the nose 166. The screws 173 extend through holes 175 formed through the adaptor 172.

Figure 3:
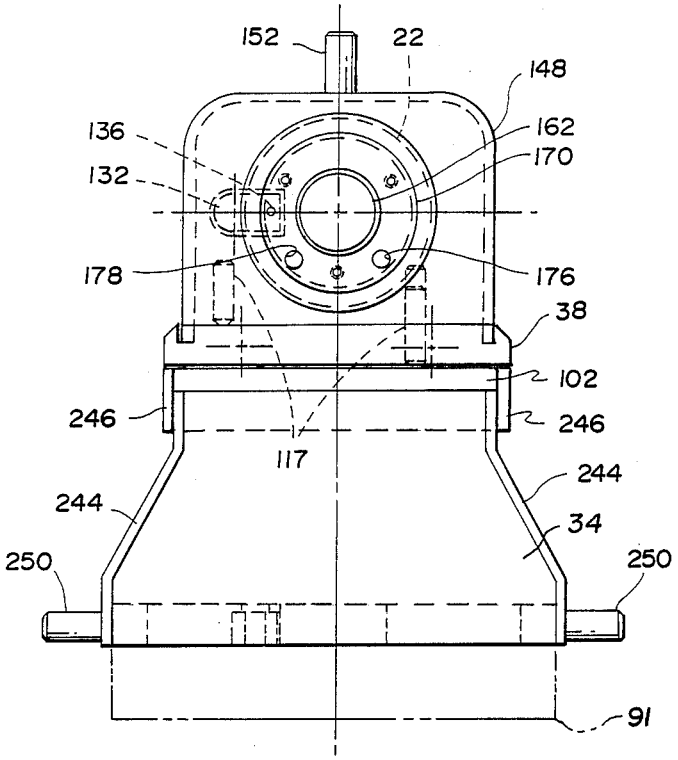
FIG. 3 is a front elevational view of the device of FIG. 2.
Figure 4:
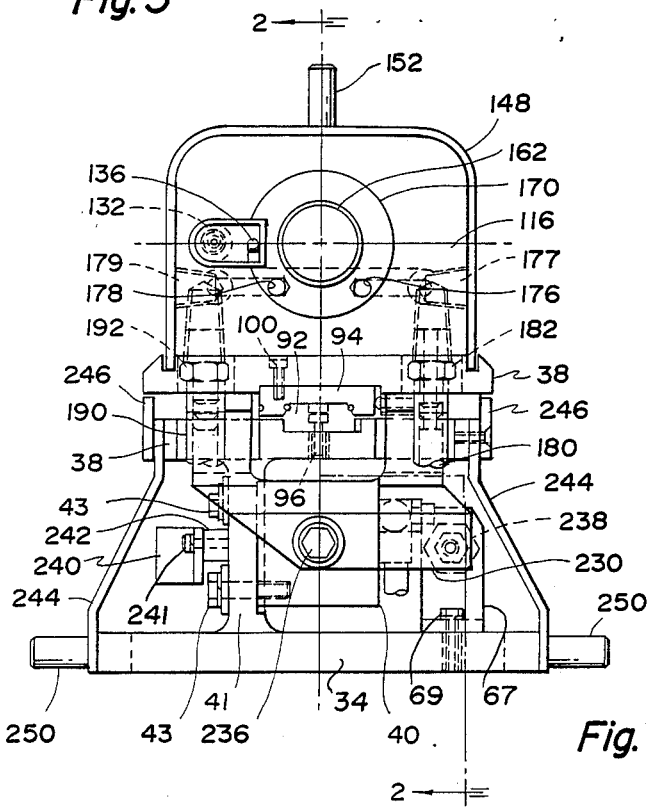
FIG. 4 is a sectional view taken along lines 4—4 of FIG. 2.
Figure 7:
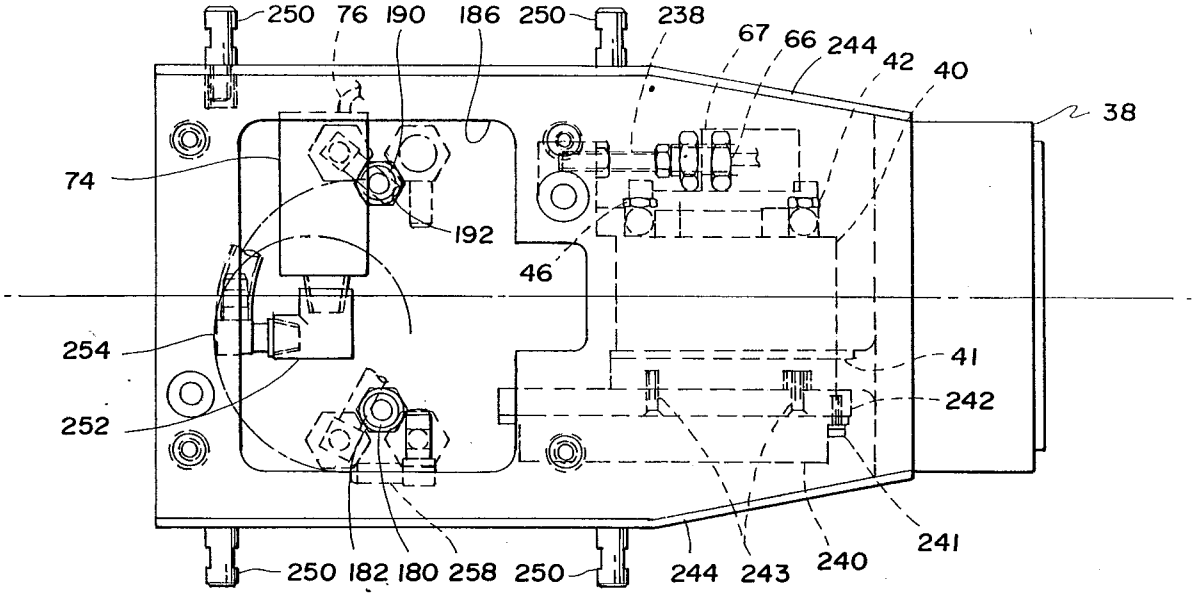
FIG. 7 is a bottom view of the device of FIG. 2.

As best shown in FIGS. 3, 4 and 5, the nose 170 has formed therein a screw pickup vacuum port 176 and a screw part evacuation vacuum port 178. The port 176 is in fluid communication with plastic tubing 180 via a male connector 182 which extends through the slide 38 at a hole 184. The tubing also extends through a corresponding aperture in the base 34 which is in communication with the hole 184. The plastic tubing 180, in turn, is in fluid communication with the vacuum switch 74, as best shown in FIG. 7 wherein various vacuum lines extend through an aperture 186 formed in the bottom portion of the base 34.

As shown in FIGS. 4 and 5, a pipe plug 177 closes the aperture in the housing 116 in fluid communication with the port 176. Likewise, a pipe plug 179 closes the aperture formed in the housing 116 in communication with the port 178.

The port 178 is in communication with its respective plastic tubing 190 via its respective male connector 192. The plastic tubing 190 extends through an aperture 194, also extending through the slide 38 and in communication with the corresponding aperture in the base 34.

As shown in FIG. 10, the adaptor 172 also includes a corresponding screw pickup port 196 which corresponds to the screw pickup port 176 formed in the nose 170. Likewise, the adaptor 172 includes a screw particulate evacuation port 198 in fluid communication with the screw particulate evacuation port 178 formed in the nose 170. An aperture 200 allows the screw rod 136 to extend therethrough and engage a ring 202 disposed within an annular groove 203 formed in a shield 204, as shown in FIG. 8. In FIG. 8 the aperture 200 is 90° out of position from the position shown in FIG. 9. The shield 204 is described in greater detail hereinbelow.

The port 196 is in fluid communication with the outer circumferential surface of the chuck 162 and the inner circumferential surface of the adaptor 172 as well as the outer circumferential surface of the extension drive 164.

The extension drive 164 extends through a spring 206 which biases the adaptor 172 away from a hollow cylindrical screw tip 208 which houses the extension drive 164. The interior of the screw tip 208 is in fluid communication with the port 196.

A collar 210 is threadedly secured at one end thereof to one end of the adaptor 172 and one end of the screw tip 208 to prevent a first negative pressure within the screw tip 208 from escaping.

A port 198 is in fluid communication with the outer exterior surfaces of the screw tip 208 and the collar 210 to provide a second negative pressure around the screw tip 208 of the previously mentioned compartment 212 formed between the free end of the screw tip 208 and the inner cylindrical surface of the shield 204.

A spring 214 biases the adaptor 172 and the shield 204 away from each other so that movement of the shield 204 towards the adaptor 172, as best shown in FIG. 8, compresses the spring 214 and causes the screw rod 136 to move rearwardly, as shown in FIG. 2.

A pin assembly 216 couples a socket 218 of the drive bit 60 to the extension drive 164 in driving engagement thereof for driving the screw fastener 62 which, preferably, is a screw having an integral washer. The washer portion of the screw fastener 62 sealingly engages an O-ring 220 which is positioned in an annular groove 222 formed in the screw tip 208. The O-ring separates the first negative pressure within a drive compartment 224 formed within the screw tip 208 from the second negative pressure in the work compartment 212 formed in the shield 204.

In clean and non-clean room applications of the device 22, the second negative pressure is applied within the motor assembly 52 in order to cool the motor 54. As shown in FIGS. 2, 5, 6 and 11, the second negative pressure is supplied to the motor cavity 213 by means of a flexible plastic hose 215 which extends through an aperture 217 in the slide 38. A fitting 219 secures the hose 215 within the motor compartment 213.

Figure 12:
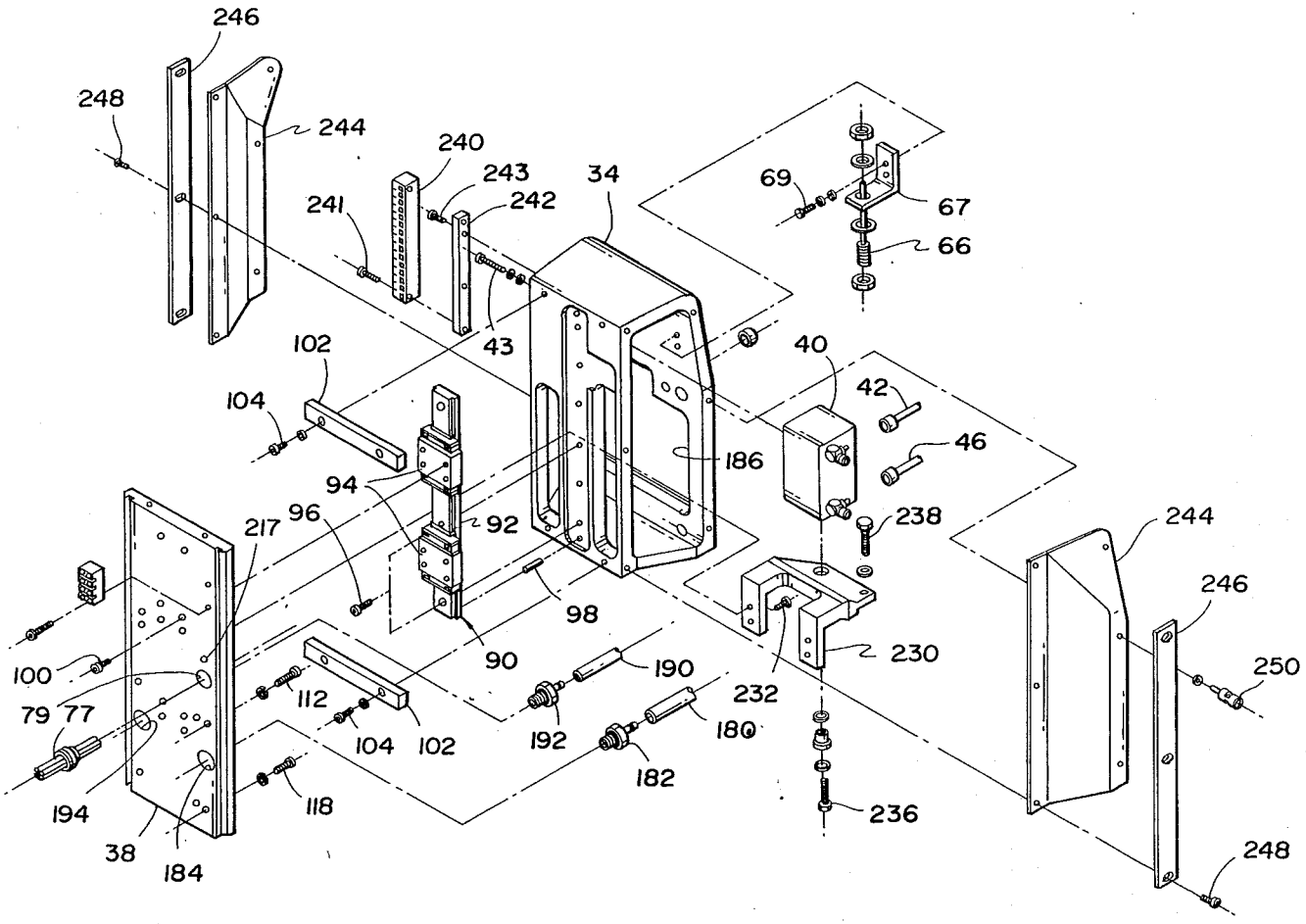
FIG. 12 is an exploded perspective view of the bottom half of the device.

Referring now to FIGS. 2, 4 and 12, there is illustrated a U-shaped coupling 230 which is mounted for movement on the slide 38 by screws 232. A plunger 234 of the air cylinder 40 is connected to the coupling 230 by a screw and coupling assembly 236 so that the air cylinder 40 can move the slide 38 by extending or retracting the plunger 234. The control lines 42 and 46 are fluidly connected to the air cylinder 40 as previously noted to control the extension and retraction of the plunger 234.

As best shown in FIGS. 2, 4, 6, 7 and 12, the air cylinder 40 is fixedly mounted to a downwardly projecting flange portion 41 of the base 34 by screw assemblies 43. The proximity switch 66 is supported by a bracket 67 which, in turn, is secured to the base 34 by screws 69.

A screw and nut assembly 238 is also mounted on the coupling 230 to cause the proximity switch 66 to indicate that the air cylinder 40 is in its retracted state. As previously mentioned, when the air cylinder 40 is in its retracted state, a signal is sent from the transducer 66 to the controller 26 along line 68 so that the controller 26 knows that it is safe to move the robot 24 away from the base 30.

Referring again to FIGS. 4, 7 and 12, a terminal strip 240 is fixedly connected to the flange portion 41 to provide a location where the electrical wires 77 are connected. The terminal strip 240 is spaced away from the flange portion 41 by an insulator strip 242. Screws 241 secure the terminal strip 240 to the insulator strip 242 and screws 243 secure the insulator strip 242 to the flange 41.

Covers 244 are mounted to the base 34 on opposite sides thereof, together with shields 246, by screws 248. Locating pins 250 are also provided to locate the driver assembly in a tool changer nest and to hold the covers on the base 34.

Referring again to FIG. 7, the vacuum switch 74 is fluidly connected by a union T 252 and a male elbow 254 to the plastic hose 180.

As can be readily appreciated, through a slight modification of the nose 166 and the adaptor 58, the nose 166 and the tip assembly 52 may be automatically removed from the rest of the motor assembly 52 as a unit, so that the device 22 can readily change a tool bit much like a robot can change end effectors. The broad concept of automatically changing bit drivers is illustrated in the above-noted patent to Booker U.S. Pat. No. 4,561,506.

Figure 13A:
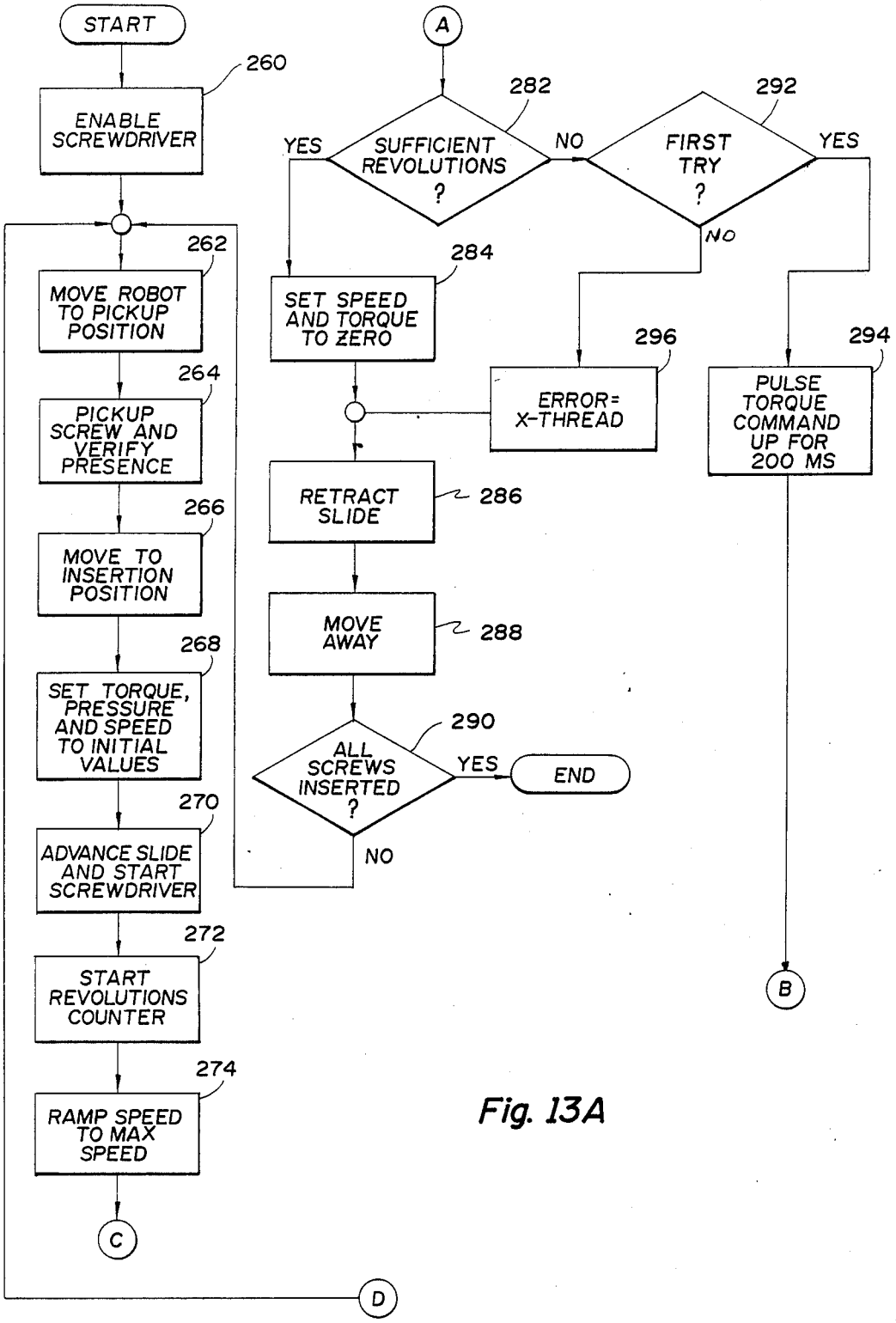

Referring now to FIGS. 13A and B, there is illustrated in block diagram, flowchart form the various steps of the method and system of the present invention.

With particular reference to FIGS. 1 and 13A, at step 260, the motor 54 is enabled through the motor control 78 and the controller 26.

In step 262, the controller 26 moves the robot 24 to a pickup position for picking up a part or screw, such as the screw fastener 62, and its presence is verified by the vacuum switch 74 as shown in FIG. 8.

In step 266, the robot 24 under control of the controller 26 moves the device 22 to an insertion position With respect to the second part 32, as generally shown in FIG. 1.

In step 268, the controller 26 has torque, axial pressure and speed values set to the initial values which were previously programmed within the controller 26.

At step 270, the air cylinder 40 advances the slide 38 under control of the solenoid valve 44 which received the control signal from the controller 26. At the same time, the motor 54 is energized from the motor control 78 under control of the controller 26.

At step 272, the internal counter within the controller 26 begins to count the number of revolutions of the drive tool 60 for monitoring the back EMF of the motor 54 along line 80.

In step 274, the speed at which the motor 54 turns the drive tool 60 is increased to its maximum speed under control of the motor controller 70 which receives its control signal along line 82.

At block 276, the controller 26 checks to see whether it has received a signal from the position transducer 64 along line 65 which indicates that the screw fasteners 62 are close to being fully inserted into the second part 32. In particular, as illustrated in FIGS. 2 and 5, the controller checks to see whether the proximity switch 140 has emitted a signal (i.e. when the collar 126 is above the proximity switch 140 which, in turn, indicates that the screw rod 136 is in a retracted position caused by the screw rod 136 being in the position indicated in FIG. 9, wherein the screw 62 has seated against part 32).

If the signal is received from the proximity switch 140, the torque, pressure and speed are set to their rundown values in block 278 to provide a "human-like" touch to fully screw down the screw fastener 62. In other words, initially the screw fastener 62 is quickly driven. When the screw fastener 62 is almost completely driven within the second part 32, the speed at which the screw fastener 62 is driven slows down to prevent damage to either the screw fastener 62 or the second part 32 thereby ensuring proper insertion of the screw fastener 62 relative to the second part 32.

At block 282, the controller 26 tests to see whether the final torque value has been obtained by monitoring the input torque from the motor control 78 along line 80. If the final torque value has been reached, the controller 26 checks to see if the screw fastener 62 has undergone a sufficient number of revolutions. The controller 26 is able to determine this value from monitoring the back EMF of the motor 54 through the motor control 78 along line 80. As previously mentioned, the back EMF is a function of the rpm of the motor 54.

If the sufficient number of revolutions has been reached, then the controller 26 sets the speed and torque signals applied to the motor control 78 along line 82 to "0" at block 284.

At block 286, the controller 26 sends a signal to the solenoid valve 44 to retract the air cylinder 40 to cause the slide 38 to retract.

At block 288, the controller 26 sends a signal to the robot 24 along line 70 to move the device 22 away from the second part 32.

At block 290, the controller 26 checks to see if all the screws have been inserted within the second part 32. If all the screw have not been inserted, then the robot 24 is moved to the screw fastener pickup position as indicated by block 262 in order to repeat the cycle.

Referring again to block 282, if a sufficient number of revolutions has not been reached, the controller 26 tests, at block 292, to see if it is the first try. If it is the first try, at block 294, a pulse torque command which is applied by the controller 26 through the motor control 78 to the motor 54 for 200 ms. in order to complete the fastening operation.

If it is not the first try at block 292, an error message is generated at block 296 indicating that the screw fastener 62 is cross-threaded. The slide 38 is again retracted as indicated at block 286.

Referring again to block 280, if the input torque has not been reached, the controller 26 checks at block 298 to see if the amount of time given for inserting the particular screw fastener has been exceeded. If the time has not been exceeded, then the torque input is again checked at block 280.

If the time has been exceeded, previous torque commands from the controller 26 are set to zero at block 300.

At block 302, an error signal is generated indicating that the screw fastener 62 is stripped.

At block 304, the slide 38 is again retracted.

At block 306, the controller 26 controls the robot 24 so that the robot 24 moves the device 22 away from the second part 32.

At block 308, the controller 26 checks to see if all of the screw fasteners have been inserted. If all the screws have not been inserted, then the robot 24 is again moved to the pickup station under control of the controller 26 to pick up another screw fastener, such as the screw fastener 62.

Referring again now to block 276, if the signal is not forthcoming from the proximity switch 140, the controller 26 checks to see if the allowed amount of time in a particular screw fastening cycle has been exceeded at block 310. If the time has not been exceeded, the controller 26 again checks to see if a signal is forthcoming from the proximity switch 140 at block 276.

If the allowed amount of time has been exceeded, the controller 26 checks to see if the final value of the torque has been reached at block 312.

If the final value has not been reached, a message is generated indicating that the screw is stripped at block 314.

If the final value of the torque value has been reached, the controller 26 checks to see if the screw fastener 62 has undergone a sufficient number of revolutions at block 316.

If an insufficient number of revolutions is indicated, the controller 26 checks to see if this is the first try at block 318.

If it is the first try, the controller 26 increases the amount of torque by five inch pounds to block 320. The controller 26 checks to see if again the signal has issued from the proximity switch 140 at block 276.

If it is not the first try, an error signal is generated at block 322 indicating that the screw fastener 62 is cross-threaded. Then the slide 38 is retracted as indicated at block 304, the controller 26 causes the robot 24 to move away from the second part 32 at block 306 and then finally the controller 26 checks to see if all the screw fasteners have been inserted as indicated at block 308.

The method, system and device of the present invention provide a programmable advancing thrust profile for a "human-like" torque touch when installing and retorquing parts and/or fasteners. Also, the method, system and device can be utilized for unfastening parts and/or fasteners.

Another feature of the present invention provides alignment of the screwdriver bit to the fastener head prior to beginning the screw installation process.

By having a programmable installation torque the invention is highly flexible and can be effectively incorporated into an automated "factory of the future" due to the cost savings and environmental safety inherent therein. Also, such method, system and device are flexible and are also compatible with factory communication systems to be able to compensate for changes in the first and second parts which are driven relative to one another. Reduced tooling and fixture costs are also benefits from the use of such method, system and device.

The invention has been described in an illustrative manner, and it is to be understood, that the terminology which has been use is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A method for the automated driving of a first part at a work station, the method utilizing a robot system which includes a robot having an arm provided with a device movable relative to at least one control axis, the device including a driver for driving the first part relative to a second part positioned at a part location in the work station, the method including the steps of: automatically moving the device through a predetermined motion relative to the at least one control axis to a position adjacent the part location; and automatically controlling the device so that the driver drives the first part relative to the second part, wherein the improvement comprises:

the step of automatically controlling includes the step of controlling the driver so that the driver applies a variable programmed axial force and a variable programmed torque at a variable programmed rotary speed to the first part.

2. The method as claimed in claim 1 wherein the at least one variable programmed force is a programmed torque.

3. The method as claimed in claim 1 or claim 2 wherein the driver is controlled to apply a variable programmed axial force to the first part.

4. The method as claimed in claim 1 or claim 2 wherein the step of automatically controlling includes the step of controlling the driver so that the driver drives the first part at a variable programmed speed.

5. The method as claimed in claim 1 wherein the first part is a screw and wherein the driver includes a screwdriver.

6. The method as claimed in claim 5 wherein the screwdriver applies a variable programmed torque to the screw.

7. The method as claimed in claim 5 or claim 6 wherein the screwdriver is controlled to apply a variable, programmed axial force to the screw.

8. The method as claimed in claim 5 or claim 6 wherein the step of automatically controlling includes the step of controlling the screwdriver so that the screwdriver drives the screw at a variable, programmed rotary speed.

9. The method as claimed in claim 1 or claim 5 wherein the step of automatically controlling includes the step of generating a force feedback signal representative of the torque applied by the driver to the first part.

10. The method as claimed in claim 1 or claim 5 wherein the step of automatically controlling includes the step of generating a position feedback signal representative of the current position of the first part relative to the second part and wherein the torque is a function of the position feedback signal.

11. The method as claimed in claim 1 or claim 5 wherein the step of automatically controlling includes the step of generating a speed feedback signal representative of the speed at which the programmed force is applied.

12. The method as claimed in claim 1 or claim 5 further including the steps of:

receiving the first part within a drive compartment formed in the device; and generating a part present signal to indicate that the first part is properly received within the drive compartment, the driver applying the at least one programmed force to a driven portion of the first part within the drive compartment during driving thereof.

13. The method as claimed in claim 12 wherein the step of generating is performed before the step of automatically moving.

14. The method as claimed in claim 12 further including the step of retaining the first part within the drive compartment.

15. The method as claimed in claim 14 wherein the step of retaining is accomplished by maintaining a negative pressure in the drive compartment.

16. The method as claimed in claim 15 wherein said step of generating is accomplished by sensing the pressure in the receiving compartment to produce the part present signal.

17. The method as claimed in claim 1 or claim 5 wherein the driver is movable between extended and retracted positions relative to the robot arm and wherein the step of automatically controlling includes the step of controllably moving the driver.

18. A method for the automated driving of a first part at a work station, the method utilizing a robot system which includes a robot having an arm provided with a device movable relative to at least one control axis, the device including a driver for driving the first part relative to a second part positioned at a part location in the work station, the method including the steps of: automatically moving the device through a predetermined motion relative to the at least one control axis to a position adjacent the part location; and automatically controlling the device so that the driver drives the first part relative to the second part, wherein the improvement comprises:

the step of automatically controlling includes the step of controlling the driver so that the driver applies at least one variable programmed force to the first part and further comprising the step of maintaining a first negative pressure in a work compartment formed in the device, the work compartment being in fluid communication with the first and second parts, the first negative pressure being sufficient to evacuate any particulate from the work compartment created during driving of the first part relative to the second part.

19. The method as claimed in claim 18 further including the step of maintaining a second negative pressure in a drive compartment of the device, the driver applying the at least one programmed force to a driven portion of the first part within the drive compartment during driving thereof.

20. The method as claimed in claim 19 wherein the first and second negative pressures have different values.

21. A system for controlling the automated driving of a first part at a work station, the system including a robot having an arm, a controller for controlling the robot in accordance with a robot control signal, a device mounted on the robot arm and movable relative to at least one control axis, the device having a driver for driving the first part relative to a second part positioned at a part location in the work station, wherein the improvement comprises:

the controller controlling the device so that the driver applies a variable programmed axial force and a variable programmed torque at a variable programmed rotary speed to the first part in accordance with drive control signals.

22. The system as claimed in claim 21 wherein the first part is a screw and wherein the driver is a screwdriver.

23. The system as claimed in claim 21 or claim 22 wherein the at least one variable programmed force is a programmed torque.

24. The system as claimed in claim 21 or claim 22 wherein the at least one programmed force is a variable programmed axial force.

25. The system as claimed in claim 21 or claim 22 wherein the controller controls the driver to apply a variable programmed axial force to the first part in accordance with a second drive control signal.

26. The system as claimed in claim 25 wherein the controller controls the driver to drive the first part at a variable programmed speed in accordance with a third drive control signal.

27. The system as claimed in claim 21 or claim 22 further including force feedback means for producing a force feedback signal representative of the torque applied by the driver to the first part.

28. The system as claimed in claim 21 or claim 22 further including position feedback means for producing a position feedback signal representative of the current position of the first part relative to the second part.

29. The system as claimed in claim 21 or claim 22 further including speed feedback means for producing a speed feedback signal representative of the speed at which the torque is applied.

30. The system as claimed in claim 21 or claim 22 wherein the device has a drive compartment formed therein for receiving the first part, and wherein the system further includes part present feedback means for producing a part present signal to indicate that the first part is properly received within the drive compartment, the driver applying the at least one programmed force to a driven portion of the first part within the drive compartment during driving thereof.

31. The system as claimed in claim 30 further including means for retaining the first part within the drive compartment.

32. The system as claimed in claim 31 wherein said means for retaining includes means for maintaining a negative pressure in the drive compartment.

33. The system as claimed in claim 32 wherein said part present feedback means includes a pressure sensor for sensing the pressure in the drive compartment, the pressure sensor producing the part present signal.

34. The system as claimed in claim 21 or claim 22 wherein the driver includes a drive tool and an actuator for moving the drive tool between extended and retracted positions relative to the robot arm and wherein the controller controls the actuator to move the drive tool in accordance with an actuator control signal.

35. A system for controlling the automated driving of a first part at a work station, the system including a robot having an arm, a controller for controlling the robot in accordance with a robot control signal, a device mounted on the robot arm and movable relative to at least one control axis, the device having a driver for driving the first part relative to a second part positioned at a part location in the work station, wherein the improvement comprises:

the controller controlling the device so that the driver applies at least one variable programmed force to the first part in accordance with a drive control signal and further including means for maintaining a first negative pressure in a work compartment formed in the device, the work compartment being in fluid communication with the first and second parts, the negative pressure being sufficient to evacuate any particulate from the work compartment created during driving of the first part relative to the second part.

36. The system as claimed in claim 35 further including means for maintaining a second negative pressure in a drive compartment of the device, the driver applying the at least one programmed force to a driven portion of the first part within the drive compartment during driving thereof.

37. The system as claimed in claim 36 wherein the first and second negative pressures have different values.

38. A device for use in an automated part driving system including a controller for providing control signals including a robot control signal and a robot having an arm adapted to support the device for movement relative to at least one control axis so that the robot moves the device at a work station relative to the control axis to permit the device to automatically drive a first part relative to a second part located at the work station, the device comprising:

a base adapted to be connected to the robot arm for movement therewith; and a driver mounted on the base and including a drive tool and actuator means adapted to receive drive control signals from the controller and coupled to the drive tool so that the drive tool applies a variable programmed axial force and a variable programmed torque at a variable programmed rotary speed to the first part in accordance with the drive control signals.

39. The device as claimed in claim 38 wherein the drive tool is mounted on the base for movement between extended and retracted positions relative to the robot arm and wherein the actuator means is adapted to receive one of the drive control signals from the controller for controllably moving the drive tool between the extended and retracted positions in accordance with the one of the drive control signals.

40. The device as claimed in claim 38 or claim 39 wherein the at least one programmed force is a variable programmed torque.

41. The device as claimed in claim 39 wherein the first part is a screw and wherein the driver is a screwdriver.

42. The device as claimed in claim 39 or claim 40 wherein the actuator means linearly moves the drive tool so that the drive tool applies a variable, programmed, axial force to the first part in accordance with the second drive control signal from the controller.

43. The device as claimed in claim 39 or claim 40 wherein the drive tool applies the at least one programmed force to the first part at a variable, programmed speed in accordance with a third drive control signal from the controller.

44. The device as claimed in claim 39 or claim 40 further comprising position feedback means for producing a position feedback signal representative of the current position of the first part relative to the second part.

45. The device as claimed in claim 39 or claim 40 wherein the device has a drive compartment formed therein for receiving the first part and wherein the device further comprises part present feedback means for producing a part present signal to indicate that the first part is properly received within the drive compartment.

46. The device as claimed in claim 45 further comprising means for retaining the first part within the drive compartment.

47. The device as claimed in claim 46 wherein said means for retaining includes means for maintaining a negative pressure in the drive compartment.

48. The device as claimed in claim 47 wherein said part present feedback means includes a pressure sensor for sensing the pressure in the drive compartment, the pressure sensor producing the part present signal.

49. The device as claimed in claim 39 wherein said actuator means includes an electric motor for receiving one of the drive control signals and applying the variable programmed torque in response thereto.

50. The device as claimed in claim 49 wherein said actuator means further includes a linear motor for receiving a second one of the drive control signals and linearly moving the drive tool in response thereto.

51. A device for use in an automated part driving system including a controller for providing control signals including a robot control signal and a robot having an arm adapted to support the device for movement relative to at least one control axis so that the robot moves the device at a work station relative to the control axis to permit the device to automatically drive a first part relative to a second part located at the work station, the device comprising:

a base adapted to be connected to the robot arm for movement therewith; and a driver mounted on the base and including a drive tool and actuator means adapted to receive a drive control signal from the controller and coupled to the drive tool so that the drive tool applies at least one variable programmed force to the first part in accordance with the first drive control signal and further comprising means for maintaining a negative pressure in a work compartment formed in the device, the work compartment being in fluid communication with the first and second parts, the negative pressure being sufficient to evacuate any particulate from the work compartment created during driving of the first part relative to the second part.

52. The device as claimed in claim 51 further comprising means for maintaining a second negative pressure in a drive compartment of the device, the driver applying the at least one programmed force to a driven portion of the first part within the drive compartment during driving thereof.

53. The device as claimed in claim 52 wherein the first and second negative pressures have different values.

* * * * *